US008526659B2

(12) United States Patent
Nageno et al.

(10) Patent No.: US 8,526,659 B2
(45) **Date of Patent: *Sep. 3, 2013**

(54) EARPHONE AND ACOUSTIC TRANSDUCER

(75) Inventors: Koji Nageno, Tokyo (JP); Takahiro Suzuki, Saitama (JP); Takeshi Hara, Kanagawa (JP)

(73) Assignee: Sony Corporation, Tokyo (JP)

( * ) Notice: Subject to any disclaimer, the term of this patent is extended or adjusted under 35 U.S.C. 154(b) by 53 days.

This patent is subject to a terminal disclaimer.

(21) Appl. No.: 13/267,287

(22) Filed: Oct. 6, 2011

(65) Prior Publication Data

US 2012/0087533 A1 Apr. 12, 2012

(30) Foreign Application Priority Data

Oct. 12, 2010 (JP) ..... P2010-229527

(51) Int. Cl.
*H04R 25/00* (2006.01)

(52) U.S. Cl.
USPC ..... 381/380; 381/396; 381/417; 381/418

(58) Field of Classification Search
USPC ..... 381/361, 369, 370–374, 396, 417–418, 381/380
See application file for complete search history.

(56) References Cited

U.S. PATENT DOCUMENTS

| | | | | |
|---|---|---|---|---|
| 6,751,326 | B2 | 6/2004 | Nepomuceno | |
| 7,206,428 | B2 * | 4/2007 | Geschiere et al. | 381/368 |
| 7,657,048 | B2 * | 2/2010 | van Halteren et al. | 381/368 |

* cited by examiner

*Primary Examiner* — Suhan Ni
(74) *Attorney, Agent, or Firm* — Wolf, Greenfield & Sacks, P.C.

(57) ABSTRACT

An earphone includes an earphone casing inside which a sound path that guides sound to a sound discharging hole is formed, and an acoustic transducer disposed inside the earphone casing. The acoustic transducer includes an accommodation casing having accommodated therein a yoke on which paired magnets disposed so as to face each other are mounted, a coil to which a driving current is supplied, an armature provided with a vibrating part vibrating when the driving current is supplied to the coil, the vibrating part being disposed between the paired magnets, and a diaphragm coupled to the vibrating part of the armature, a sound output hole is formed on a surface that faces a vibration surface of the diaphragm in the accommodation casing, and the acoustic transducer has the sound output hole disposed in the earphone casing so that the sound output hole is acoustically coupled to the sound path.

7 Claims, 10 Drawing Sheets

EARPHONE AND ACOUSTIC TRANSDUCER

BACKGROUND

The present disclosure relates to an earphone and an acoustic transducer and, in particular, those using a balanced armature unit.

An example of an acoustic transducer for use in an earphone and others is a so-called balanced armature unit as described in U.S. Pat. No. 6,751,326.

An example of an outer view of the balanced armature unit is depicted in FIG. 10. In this balanced armature unit, a yoke, a coil, an armature, and a diaphragm are accommodated in an accommodation casing 100 with a predetermined arrangement. With a driving current flowing through the coil, the armature is vibrated. That vibration is transferred to the diaphragm to produce sound.

In this balanced armature unit, a funnel-shaped member 101 is integrally mounted on the accommodation casing 100. This member 101 has a sound output hole 101*a*.

The sound obtained by the inner diaphragm is outputted from the sound output hole 101*a* of the member 101 to the outside of the unit.

This balanced armature unit is mounted inside of an earphone. In this case, in order to guide sound to an earpiece part to be inserted in an ear hole of a user, a sound path in an earphone casing and the member 101 are coupled together with a tube.

SUMMARY

In the earphone structure using this balanced armature unit, however, the following problems arise.

First, although the balanced armature unit itself is suitable for decreasing the size because the driving system and the vibrating system are accommodated in one unit case, in order to couple the funnel-shaped member 101 and the sound path in the earphone casing together with the tube, a space for disposing the tube is provided, thereby restricting a decrease in the entire size of the earphone.

Also, obtaining the funnel-shaped member 101 by processing with a high degree of accuracy and mounting it with hermeticity to the sound path is a task at a high degree of difficulty, which is disadvantageous in manufacturing cost and manufacturing efficiency. Moreover, due to the accuracy and degree of difficulty in mounting of the member 101, hermeticity of the sound path is less prone to being stable and as a result, acoustic performance for each product is less prone to being stable.

Still further, since the diameter (the sectional area) of the sound output hole 101*a* of the member 101 is not large by reason of structure, attenuation occurs in high frequencies. Therefore, a loss in sound quality occurs in the sound reaching the user's ear.

It is desirable to provide an earphone using a balanced armature unit, the earphone that is easy to manufacture, advantageous for decreasing the size, and stable in acoustic performance.

An acoustic transducer according to an embodiment of the present disclosure includes an accommodation casing having accommodated therein a yoke on which paired magnets disposed so as to face each other are mounted, a coil to which a driving current is supplied, an armature provided with a vibrating part vibrating when the driving current is supplied to the coil, the vibrating part being disposed between the paired magnets through the coil, and a diaphragm coupled to the vibrating part of the armature. A sound output hole is formed on a surface that faces a vibration surface of the diaphragm in the accommodation casing.

An earphone according to another embodiment of the present disclosure includes an earphone casing inside which a sound path that guides sound to a sound discharging hole is formed and the acoustic transducer according to the embodiment of the present disclosure disposed inside the earphone casing. The acoustic transducer has the sound output hole disposed in the earphone casing so that the sound output hole is acoustically coupled to the sound path.

For example, the acoustic transducer has the sound output hole disposed in the earphone casing so that the sound output hole faces the sound path. In this case, the sound output hole may face the sound path via a shock absorbing member.

Alternatively, an air chamber communicating with the sound path is formed in the earphone casing in which the acoustic transducer is disposed, and the acoustic transducer is disposed in the earphone casing so that an output sound from the sound output hole reaches the sound path via the air chamber.

Alternatively, the acoustic transducer is disposed in the earphone casing so that the sound output hole is positioned inside the sound path.

Also, the sound output hole of the acoustic transducer is formed at a position eccentric from a center on the surface that faces the vibration surface of the diaphragm.

In these embodiments of the present disclosure, the acoustic transducer of the embodiment of the present disclosure as a balanced armature has a sound output hole formed on one surface of the accommodation casing, that is, a surface that faces the diaphragm inside. In this structure, the funnel-shaped member as depicted in FIG. 10 can be omitted, and the sound output hole can be increased.

In the earphone of the embodiment of the present disclosure, the acoustic transducer is disposed so that the sound output hole of this acoustic transducer communicates with the sound path in the earphone casing directly or via the shock absorbing member. Therefore, a member that couples the sound output hole of the acoustic transducer and the sound path in the earphone casing together can be omitted.

According to the embodiments of the present disclosure, the acoustic transducer can have a simple structure with a funnel-shaped member being omitted, and can prevent the occurrence of a loss in sound quality at the sound output hole.

Also, when the acoustic transducer is mounted inside the earphone casing, all you have to do is to dispose the sound output hole of the acoustic transducer so that the sound output hole communicates with the sound path. Therefore, a member such as a tube can be omitted, which makes mounting easy and is also advantageous in decreasing the size of the earphone. Furthermore, instability in acoustic performance depending on mounting accuracy can be avoided.

For these reasons, an earphone that is easy to manufacture, simple in structure, suitable for decreasing the size, and stable in acoustic characteristics can be provided.

DETAILED DESCRIPTION OF EMBODIMENTS

Figure 1A:
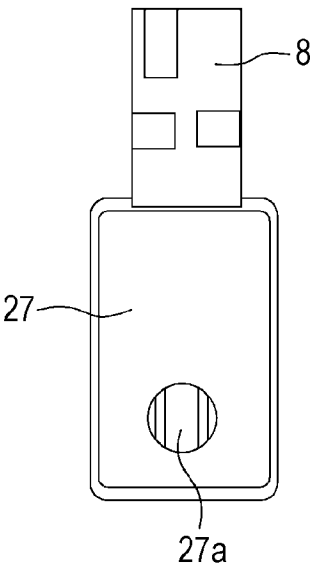
FIGS. 1A to 1E are a plan view, a side view, a bottom view, a front view, and a perspective view, respectively, of an acoustic transducer of an embodiment of the present disclosure.
Figure 1B:
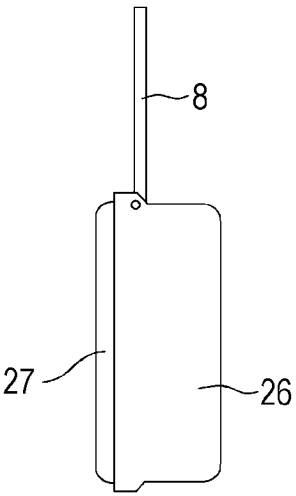
Figure 1C:
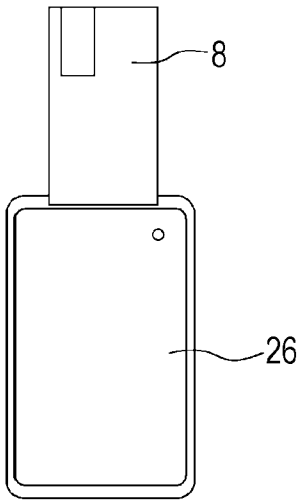

Description of the acoustic transducer and the earphone according to embodiments of the present disclosure is made according to the following sequence.

1. Structure of the Acoustic Transducer
2. First Example of Structure of the Earphone
3. Second Example of Structure of the Earphone
4. Third Example of Structure of the Earphone
5. Fourth Example of Structure of the Earphone
6. Fifth Example of Structure of the Earphone
7. Modification Example

1. Structure of Acoustic Transducer

An acoustic transducer of an embodiment is first described. The acoustic transducer of the embodiment is of a type of a so-called balanced armature unit.

FIGS. 1A to 1E are a plan view, a side view, a bottom view, a front view, and a perspective view, respectively, of an acoustic transducer 1 of the embodiment.

In the acoustic transducer 1, an accommodation unit 4 is formed of a case body 26 and a cover body 27 depicted in FIGS. 1A to 1E. This accommodation unit 4 serves as a casing of the acoustic transducer 1, and has disposed therein a yoke, a coil, an armature, a diaphragm, and others, as will be described further below.

From the accommodation unit 4, a circuit board 8 (a flexible board) is led. On this circuit board 8, a circuit part for supplying a driving signal to an inner coil is formed.

Figure 10:
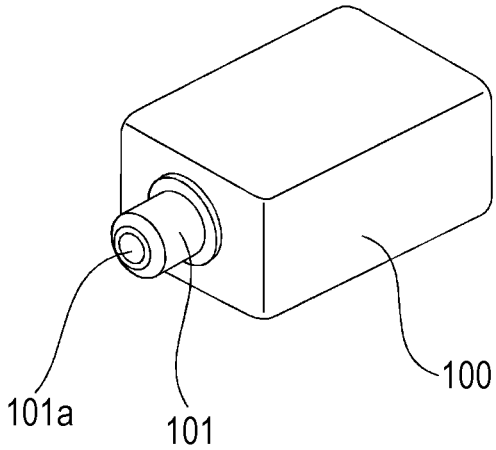
FIG. 10 illustrates an outer view of a balanced armature unit.

In the present embodiment, the funnel-shaped member 101 in the balanced armature unit of the related art in FIG. 10 is not provided. On an upper surface of the cover body 27 forming the accommodation unit 4, a sound output hole 27*a* is formed as depicted in the drawings. This sound output hole 27*a* is formed in the accommodation unit 4 and on a surface that faces a vibration surface of an inner diaphragm unit 3, which will be described further below.

Also in this example, the sound output hole 27*a* is formed at a position eccentric in a longitudinal direction from a center on the upper surface of the cover body 27.

Figure 2:
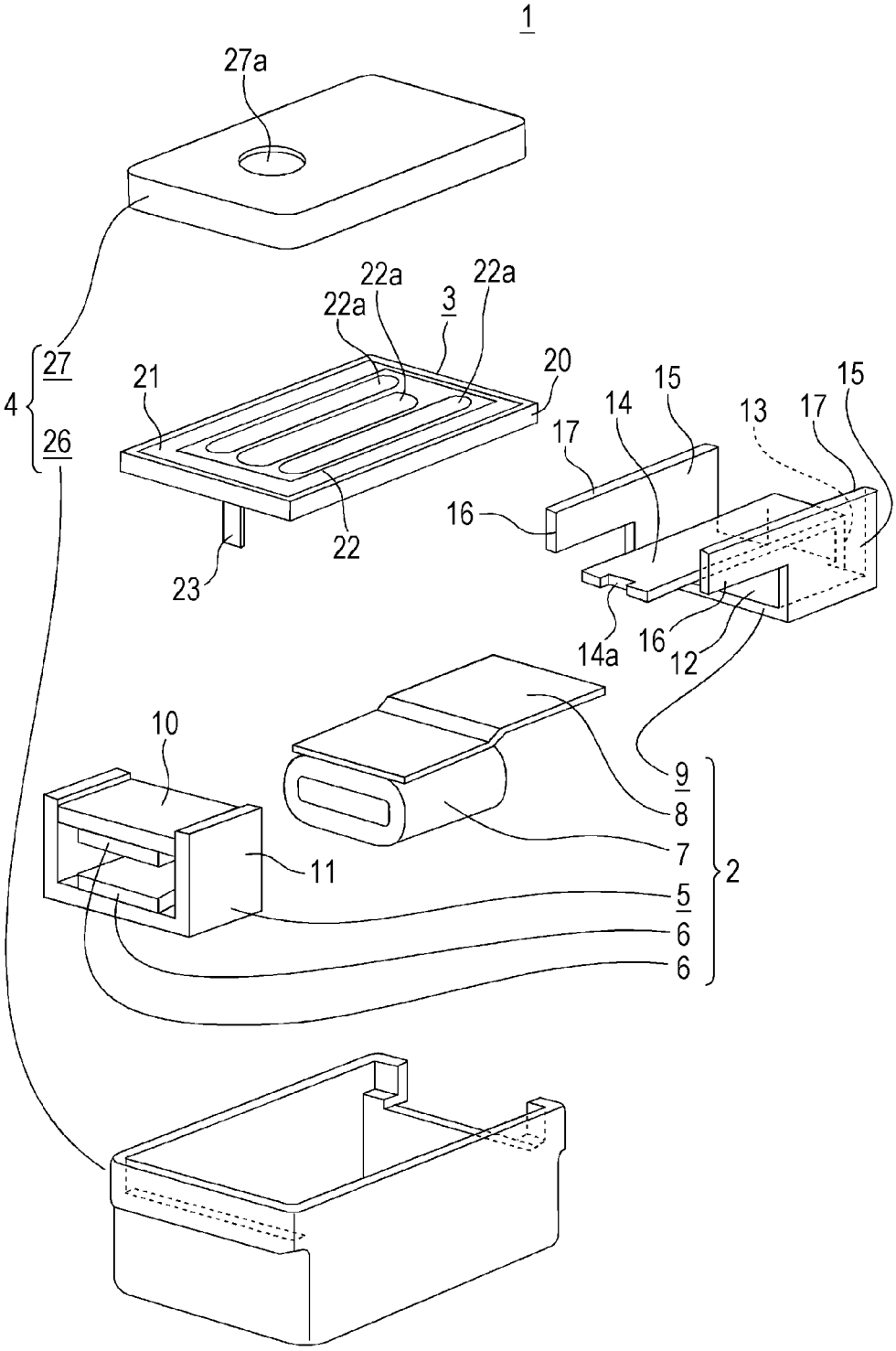
FIG. 2 is an exploded perspective view of the acoustic transducer of the embodiment.
Figure 3:
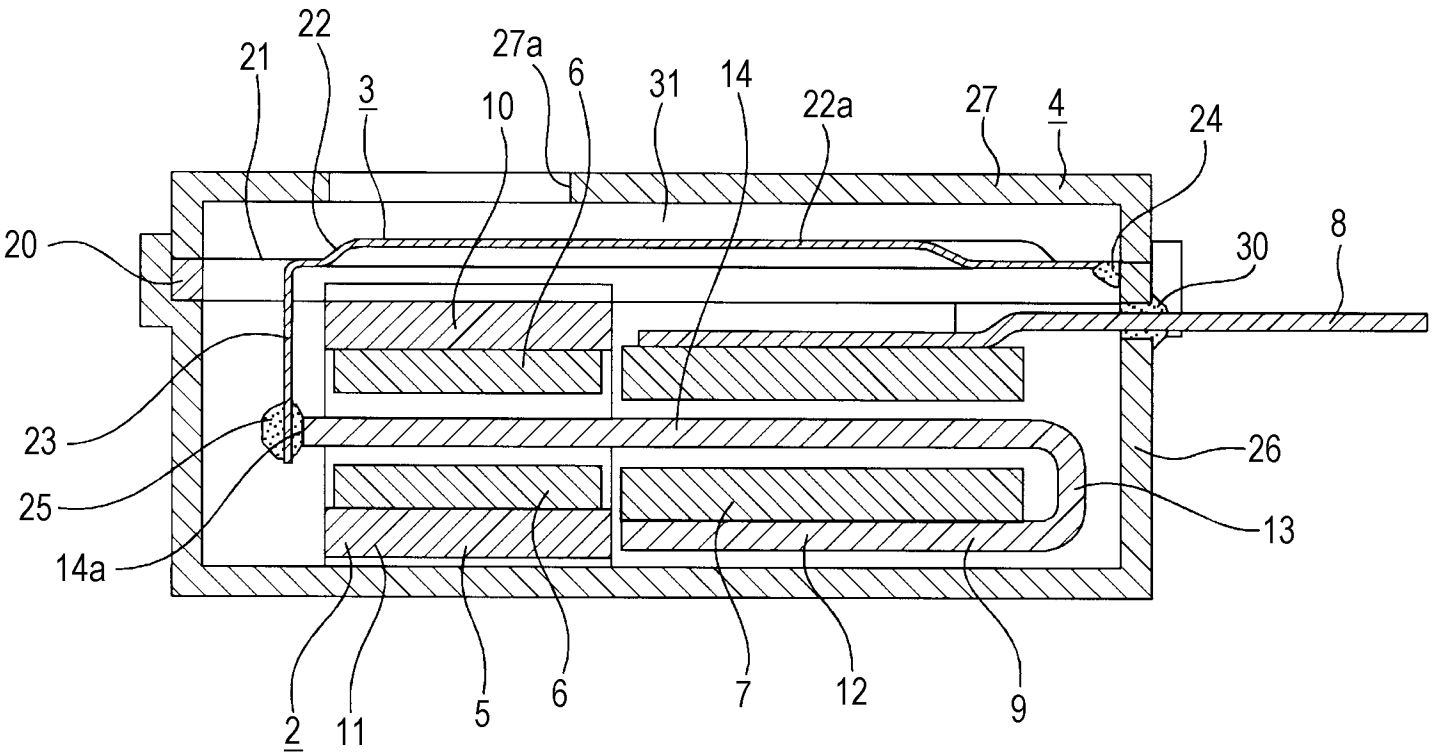
FIG. 3 is a sectional view depicting an inner structure of the acoustic transducer of the embodiment.

FIG. 2 is an exploded perspective view of the acoustic transducer 1, and FIG. 3 is a sectional view of the acoustic transducer 1. With reference to these FIGS. 2 and 3, an example of an inner structure of the acoustic transducer 1 is described.

Figure 1D:
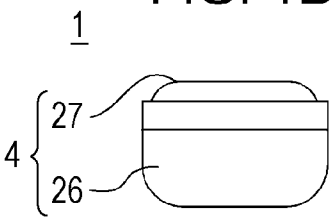
Figure 1E:
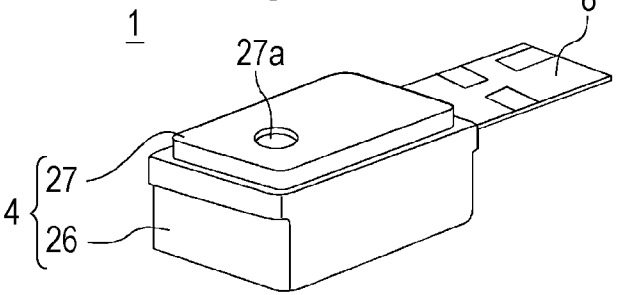

Note that, in the description of the structure of the acoustic transducer 1 below, a side depicted in the front view of FIG. 1D is taken as front, a direction in which the circuit board 8 is led is taken as rear, and representations of front, rear, above, below, left, and right are made accordingly. However, these front, rear, above, below, left, and right are merely for convenience of description.

As depicted in FIGS. 2 and 3, the acoustic transducer 1 is configured to have a driving unit 2 and the diaphragm unit 3 accommodated in the accommodation unit 4.

The driving unit 2 includes a yoke 5, paired magnets 6, a coil 7, a circuit board 8, and an armature 9.

The yoke 5 is formed of a first member 10 in a flat shape oriented in a vertical direction and a second member 11 in an invertedeC shape that is open upward, the first member 10 and the second member 11 coupled together. The first member 10 has both of left and right sides attached onto an inner surface side of the side surfaces of the second member 11 by bonding or the like. With this, the first member 10 and the second member 11 are coupled together to form the yoke 5 in a square rod shape that is hollow in a longitudinal direction.

Inside this yoke 5, the paired magnets 6 are attached. The magnets 6 are disposed so as to be separated from each other and face each other in the vertical direction, with different polarities on facing sides. The magnet 6 positioned above is attached to a lower surface of the first member 10, and the magnet 6 positioned below is attached to an upper surface of a bottom part of the second member 11.

The coil 7 is formed in a cylindrical shape with its axial direction being set in a longitudinal direction and, for example, is formed in a long hole shape. The coil 7 is in regular winding, with its upper surface and lower surface each being formed in a flat shape.

The circuit board 8 is mounted on the upper surface of the coil 7. The circuit board 8 has a length in the longitudinal direction longer than a length of the coil 7 in the longitudinal direction, and is partially mounted on the upper surface of the coil 7. An approximately rear half of this circuit board 8 protrudes rearward from the coil 7 and, furthermore, a rear side of the circuit board 8 is led from the accommodation unit 4.

Both ends of the coil 7 are connected to predetermined terminals on the circuit board 8, thereby forming an electric circuit for applying a driving current to the coil 7.

Note that because the coil 7 is in regular winding with its upper surface being formed in a flat shape, an excellent joint state between the coil 7 and the circuit board 8 can be ensured.

The armature 9 has parts made of a magnetic metal material and integrally formed.

The armature 9 has a coil mounting part 12 oriented in the vertical direction, a coupling part 13 protruding upward from a rear end of the coil mounting part 12, a vibrating part 14 protruding forward from an upper end of the coupling part 13, side wall parts 15 protruding upward from both left and right ends of the coil mounting part 12, and fixed parts 16 protruding forward from front surfaces of the side wall parts 15 in their approximately front half portion.

The vibrating part 14 has a length in the longitudinal direction longer than a length of the coil mounting part 12 in the longitudinal direction, and has its front end positioned forward from a front end of the coil mounting part 12.

At a center of a front surface of this vibrating part 14 in a horizontal direction, a coupling recessed part 14*a* that is open forward is formed.

Upper surfaces of the side wall parts 15 and upper surfaces of the fixed parts 16 are coplanar, and these coplanar surfaces positioned so as to be horizontally separated apart from each other are formed as fixing surfaces 17.

On an upper surface of the coil mounting part 12, the coil 7 is mounted by bonding, for example. Since the coil 7 is in regular winding and has its lower surface formed in a flat shape, an excellent joint state of the coil 7 with respect to the coil mounting part 12 can be ensured.

As can be seen from FIG. 3, in the state where the coil 7 is mounted on the coil mounting part 12, the vibrating part 14 penetrates through the coil 7 and partially protrudes forward from the coil 7.

In this acoustic transducer 1, the coil mounting part 12 on which the coil 7 is mounted and the vibrating part 14 to penetrate through the coil 7 are both provided on the armature 9. Therefore, the position of the vibrating part 14 with respect to the coil 7 can be ensured with a high degree of accuracy, and accuracy in position of the vibrating part 14 with respect to the coil 7 can be improved.

In the armature 9, with the coil 7 mounted on the coil mounting part 12, the fixed parts 16 are fixed by bonding or welding on outer surfaces of side surfaces of the yoke 5. With the armature 9 fixed to the yoke 5, upper surfaces of side surfaces of the yoke 5 are positioned slightly upward from the fixed surfaces 17 of the armature 9. Also, the coupling recessed part 14*a* formed at the front end of the vibrating part 14 is positioned slightly forward from directly under the front ends of the magnets 6.

Note that although the armature 9 having the parts integrally formed is taken as an example here, the armature can be any as long as it has at least the vibrating part, which is to be magnetized, formed of a magnetic metal material.

The diaphragm unit 3 includes a holding frame 20, a resin film 21, a diaphragm 22, and a beam part 23.

The holding frame 20 is made of a metal material and is formed in a longitudinally elongated frame shape, with its width in the horizontal direction approximately equal to the armature 9 in the horizontal direction.

The resin film 21 is formed so as to be equal in size to that of the outer shape of the holding frame 20, and is affixed by bonding or the like to an upper surface of the holding frame 20 so as to enclose an opening of the holding frame 20, for example.

The diaphragm 22 is made of a metal material having a thin thickness, for example, aluminum or stainless steel, and its outer shape is formed in a rectangular shape with a size slightly smaller than an inner shape of the holding frame 20. In the diaphragm 22, reinforcing ribs 22*a* longitudinally extending and positioned so as to be horizontally separated from one another are provided. These reinforcing ribs 22*a* are each formed so as to rise upward.

The diaphragm 22 is assumed to be in a state of, for example, being affixed from below to the resin film 21.

The diaphragm 22 has a rear end positioned slightly forward from an inner surface of the holding frame 20 at a rear end, and a gap is formed between the rear end of the diaphragm 22 and the inner surface at the rear end of the holding frame 20. As depicted in FIG. 3, an adhesive agent 24 is applied so as to fill this gap. Therefore, the diaphragm 22 and the holding frame 20 are connected via the adhesive agent 24 and the resin film 21.

As the adhesive agent 24, for example, an acrylic-base non-curable adhesive agent or an acrylic-base ultraviolet-curable adhesive agent is used.

Note that the adhesive agent 24 fills the gap and extends to a surface opposite to a side of the diaphragm 22 affixed to the resin film 21. That is, while the diaphragm 22 is supported by the holding frame 20 with the resin film 21, the adhesive agent 24 functions as a reinforcing member for reinforcing this support.

The beam part 23 is integrally formed with the diaphragm 22. For example, the beam part 23 is formed by partially bending the diaphragm 22 downward. The beam part 23 is formed, for example, in a narrow plate shape extending in the vertical direction.

The diaphragm unit 3 is fixed to the driving unit 2 from above by boding or laser welding, for example. That is, the diaphragm unit 3 is fixed, with the lower surface of the holding frame 20 being jointed to the fixing surfaces 17 of the armature 9.

Also, when the diaphragm unit 3 is fixed to the driving unit 2, a lower end of the beam part 23 is attached to a front end of the vibrating part 14 in the armature 9 by bonding. That is, the beam part 23 is coupled to the armature 9 with an adhesive agent 25 as being inserted in the coupling recessed part 14*a* formed in the vibrating part 14.

As described above, since the beam part 23 is integrally formed with the diaphragm 22, only by attaching the lower end of the beam part 23 to the vibrating part 14, the diaphragm 22 and the armature 9 are coupled together via the beam part 23, and the structure in which vibrations of the vibrating part 14 of the armature 9 are transferred to the diaphragm 22 is formed.

Note that the shape of the beam part 23 is not meant to be restricted to the narrow plate shape.

As described with reference to FIGS. 1A to 1E, the accommodation unit 4 includes the case body 26 in a box shape that is open upward and the cover body 27 in a shallow box shape that is open downward.

In the case body 26, the sound output hole 27*a* is formed on the upper surface. This surface where the sound output hole 27*a* is formed is a surface facing the vibration surface of the inner diaphragm 22.

As depicted in FIG. 3, a sound due to vibrations of the diaphragm 22 is discharged into a space 31 above the vibration surface. This sound is outputted from the sound output hole 27*a* formed at the position facing the vibration surface.

In the above-structured acoustic transducer 1, a driving current based on a sound signal is applied to the coil, the vibrating part 14 of the armature 9 inserted in the coil 7 and between the magnets 6 of the yoke 5 vibrates.

The vibrations of the vibrating part 14 are transmitted to the diaphragm 22 via the beam part 23 to cause the diaphragm 22 to vibrate. The sound due to the vibrations of the diaphragm 22 is discharged to the space 31 above the vibration surface depicted in FIG. 3. This sound is outputted from the sound output hole 27*a* formed on the surface facing the vibration surface.

The acoustic transducer 1 of the present embodiment is different from the acoustic transducer in related art depicted in FIG. 10 in that the sound output hole 27*a* is formed on one surface of the accommodation unit 4 and no funnel-shaped member is provided.

In this structure, since the funnel-shaped member can be omitted, a decrease in size of the acoustic transducer 1 can be promoted, and ease in manufacturing is also increased.

Furthermore, as a matter of course, an increase in accuracy of the funnel-shaped member can also be omitted.

Still further, the sound output hole 27*a* is formed on the flat part on the upper surface of the cover body 27, and can have a wide hole area. Therefore, a decrease in high frequency characteristics of output sound due to passage of the sound output hole 27*a* can also be prevented.

Still further, since the sound output hole 27*a* is formed on the upper surface of the cover body 27, which is a relatively wide surface, flexibility of the position for forming the sound output hole 27*a* is high.

2. First Example of Structure of the Earphone

Examples of structure of an earphone according to the embodiment having the above acoustic transducer 1 are described.

Figure 4A:
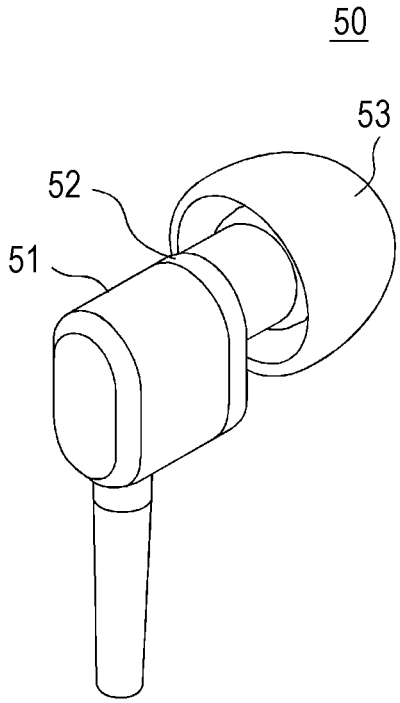
FIGS. 4A and 4B are perspective views of an earphone of another embodiment.
Figure 4B:
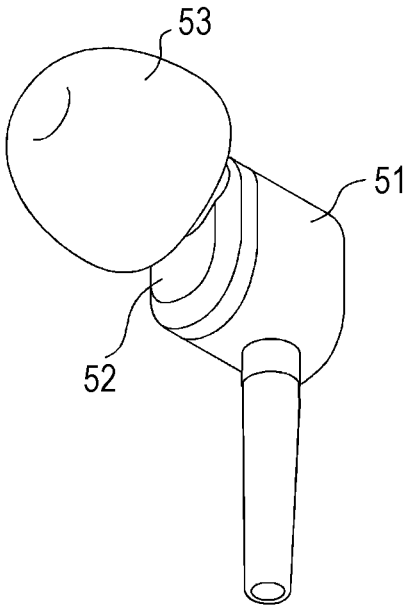

FIGS. 4A and 4B are perspective view of the outer shape of an earphone 50. The earphone 50 has a casing formed of a front casing 52 and a rear casing 51 jointed together. To the front casing 52, an earpiece 53 is attached, which is inserted in the ear hole of the user.

Note that a cord for supplying a sound signal to the earphone is omitted in the drawings.

Figure 5B:
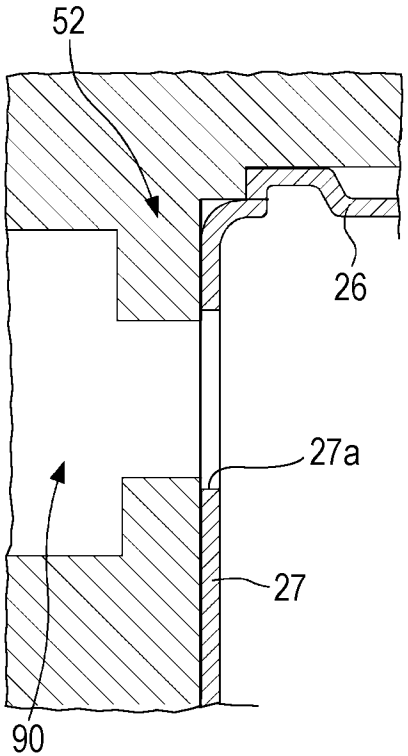
FIGS. 5A and 5B illustrate a first example of structure of the earphone of the other embodiment.
Figure 5A:
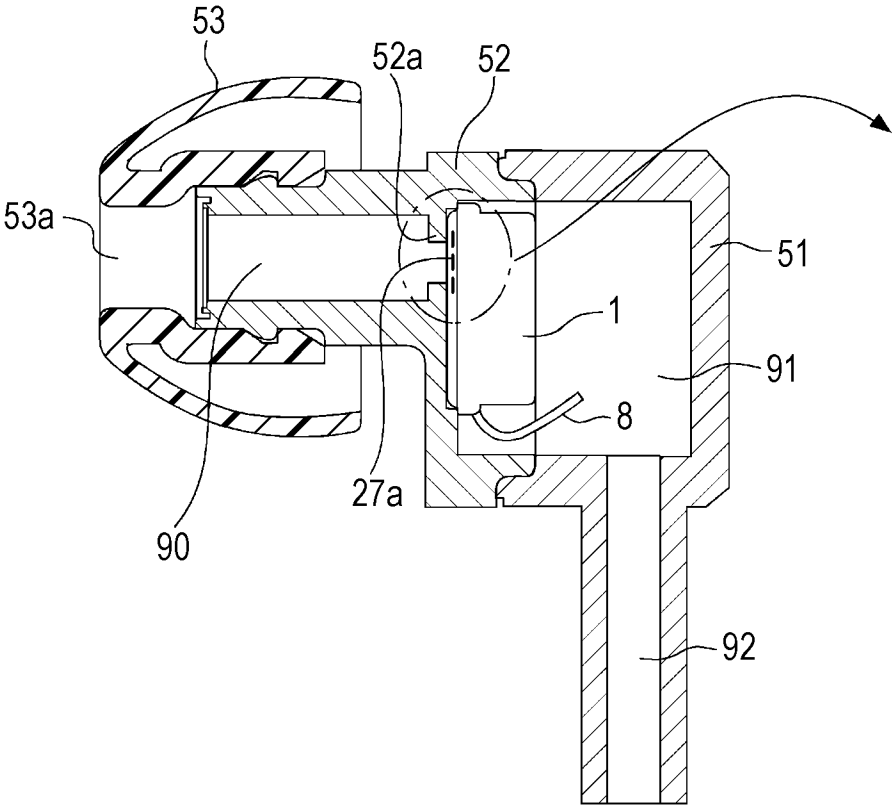

FIG. 5A depicts a first example of structure of the earphone 50. FIG. 5B is an enlarged view of a portion surrounded by a one-dot-chain line in FIG. 5A.

As depicted in FIG. 5A, the front casing 52 and the rear casing 51 are jointed together to form each space in the earphone casing. That is, a sound path tube 90 is formed inside on a front casing 52 side. Also, the front casing 52 and the rear casing 51 form an accommodation space 91. Also, a cord space 92 in which the cord not shown is inserted is formed on a rear casing 51 side.

To the front casing 52, the earpiece 53 made of, for example, a flexible material, is mounted as being engaged, for example. In this state, a sound discharging hole 53*a* of the earpiece 53 linearly communicates with the sound path tube 90.

In this case, the acoustic transducer 1 described above is fixed and disposed in the accommodation space 91. Here, as described above, the acoustic transducer 1 has the sound output hole 27*a* formed on the upper surface of the casing (the cover body 27). In FIG. 5A, the position of the sound output hole 27*a* is represented by a broken line for description.

As can be seen from FIGS. 5A and 5B, the sound output hole 27*a* of the acoustic transducer 1 is directly and acoustically coupled to the sound path tube 90. That is, the acoustic transducer 1 is disposed in the accommodation space 91 with its sound output hole 27*a* being pressed onto an end 52*a* of the sound path tube 90.

With this, the sound output hole 27*a* faces the sound path tube 90. In this case, the structure can be said such that the diaphragm 22 in the acoustic transducer 1 is disposed at an end of the sound path tube 90 via the sound output hole 27*a*.

The circuit board 8 is connected to each of lines (a sound signal line from either one of aneL channel and an R channel and a ground line) in the cord not shown and inserted in the cord space 92. Through the coil 7 inside the acoustic transducer 1, a driving current based on the sound signal of either one of theeL channel and the R channel is caused to flow.

With the driving current flowing, a sound is outputted from the sound output hole 27*a* by vibrations of the inner diaphragm 22. That sound directly reaches the sound path tube 90 and also reaches the user's ear hole from the sound discharging hole 53*a* of the earpiece 53.

The earphone 50 with the first example of structure has effects as described below.

First, the acoustic transducer 1 can have a simple structure with a funnel-shaped member being omitted.

Also, the sound output hole 27*a* of the acoustic transducer 1 can have a relatively large hole area, and a loss in sound quality can be prevented.

Furthermore, when the acoustic transducer 1 is mounted inside the casing of the earphone 50, all you have to do is to dispose the acoustic transducer 1 so that the sound output hole 27*a* faces the sound path tube 90. Therefore, a member such as a tube can be omitted, which makes mounting easy and makes the manufacturing process efficient. Still further, in addition to improvement in manufacturing efficiency, the structure is simple with a small number of components, and therefore advantageous in decreasing cost.

Still further, instability in acoustic performance due to a funnel-shaped member and depending on accuracy of mounting the tube can be eliminated.

Still further, since the tube does not have to be accommodated in the casing, the size of the earphone casing can also be advantageously decreased. With a small-sized casing structure, an earphone insertable in a good condition with less interference with the ear pinna can be provided.

Still further, since the tube does not have to be accommodated in the casing, the layout of the inner structure of the earphone casing can be simplified.

In the acoustic transducer 1 depicted in FIGS. 1A to 1E, FIG. 2, and FIG. 3, the sound output hole 27*a* is formed at a position eccentric in the longitudinal direction from the center on the upper surface of the case body 26.

This is suitable when the acoustic transducer 1 is disposed in the earphone casing at a position where the sound output hole 27*a* faces the sound path tube 90.

If the sound output hole 27*a* is formed near the center on the upper surface of the case body 26, in the earphone structure of FIGS. 5A and 5B, the space where the acoustic transducer 1 is to be disposed is widened on an upper surface side (upward in the drawing) of the earphone. As the upper surface of the earphone casing is increased (for example, when the upper surface is equivalent in height to an edge of the earpiece 53), that portion may abut particularly on the ear pinna of the user when inserted into the ear hole, thereby possibly degrading insertability. By contrast, when the sound output hole 27*a* is formed at a position eccentric from the center on the upper surface of the case body 26 and disposed as depicted in FIGS. 5A and 5B, the height of the upper surface of the earphone casing can be lowered, thereby allowing excellent insertability to the user.

However, even when the sound output hole 27*a* is formed at the center of the upper surface of the case body 26, an earphone with excellent insertability can be formed depending on the structure of the earphone casing.

3. Second Example of Structure of the Earphone

A second example of structure of the earphone according to the embodiment is described with reference to FIGS. 6A to 6C.

Note that a basic structure of the second example of structure is similar to that of the first example of structure (FIGS. 5A and 5B). In descriptions of the second to fifth examples of structure below, portions identical to those of the first example of structure are provided with the same reference characters and are not described.

Figure 6C:
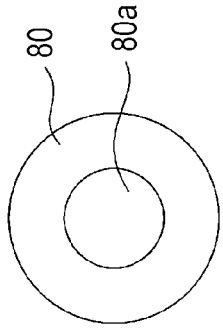
FIGS. 6A to 6C illustrate a second example of structure of the earphone of the other embodiment.
Figure 6B:
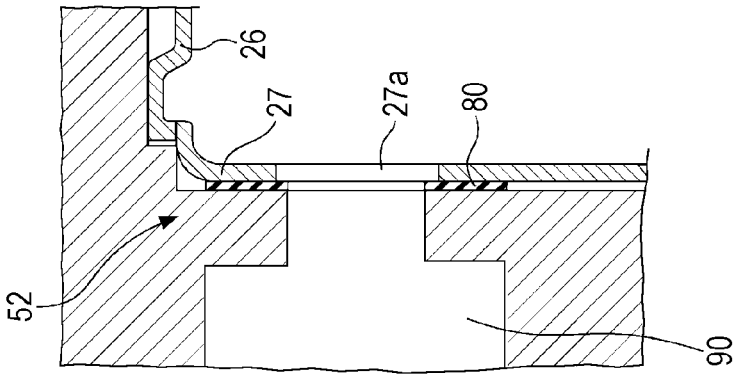
Figure 6A:
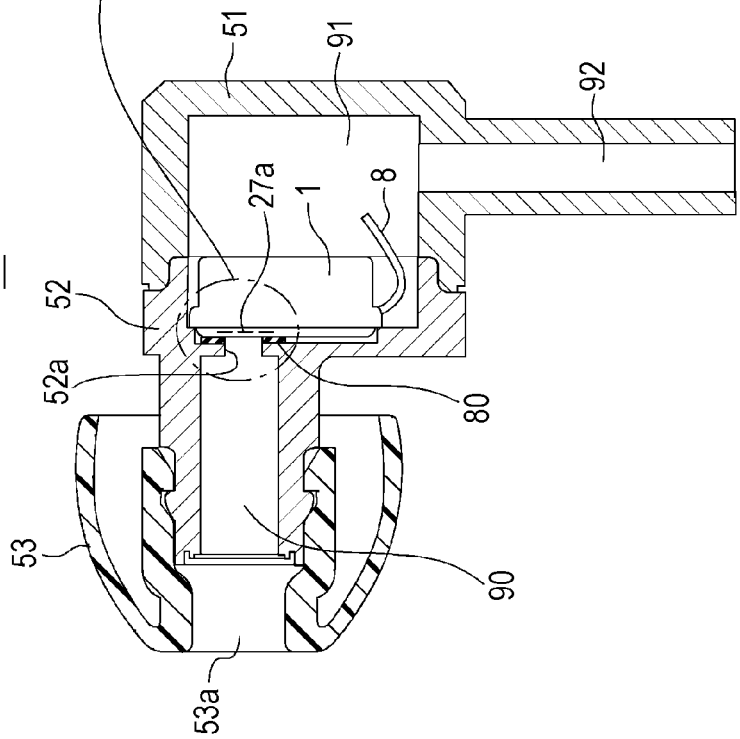

In the case of FIGS. 6A to 6C, the acoustic transducer 1 has the sound output hole 27*a* disposed so as to face the sound path tube 90 via a shock absorbing member.

FIG. 6A depicts an example of structure. FIG. 6B is an enlarged view of a portion surrounded by a one-dot-chain in FIG. 6A.

As depicted in FIGS. 6A and 6B, the sound output hole 27*a* of the acoustic transducer 1 faces the sound path tube 90 via a shock absorbing member 80 formed of a soft material. The shock absorbing member 80 is assumed to have a flat ring shape having a center hole 80*a* as depicted in FIG. 6C, for example. As a soft material, for example, a material, such as elastomer or a silicon rubber base material, with a low airflow resistance is suitable.

That is, as abutting around the sound output hole 27*a* on the cover body 27 of the acoustic transducer 1, the ring-shaped shock absorbing member 80 is in a state of being pressed onto the end 52*a* of the sound path tube 90 in the front casing 52.

Even in the case of the structure in which the acoustic transducer 1 has the sound output hole 27*a* disposed so as to face the sound path tube 90 via the shock absorbing member 80 (the center hole 80*a*), effects similar to those of the first example of structure described above can be obtained.

In addition, with the acoustic transducer 1 disposed so as to being pressed via the shock absorbing member 80, an error in molding accuracy of the front casing 52 and the rear casing 51 is effectively absorbed to eliminate the gap between the sound output hole 27*a* and sound path tube 90 and to stably mount the acoustic transducer 1.

4. Third Example of Structure of the Earphone

Figure 7:
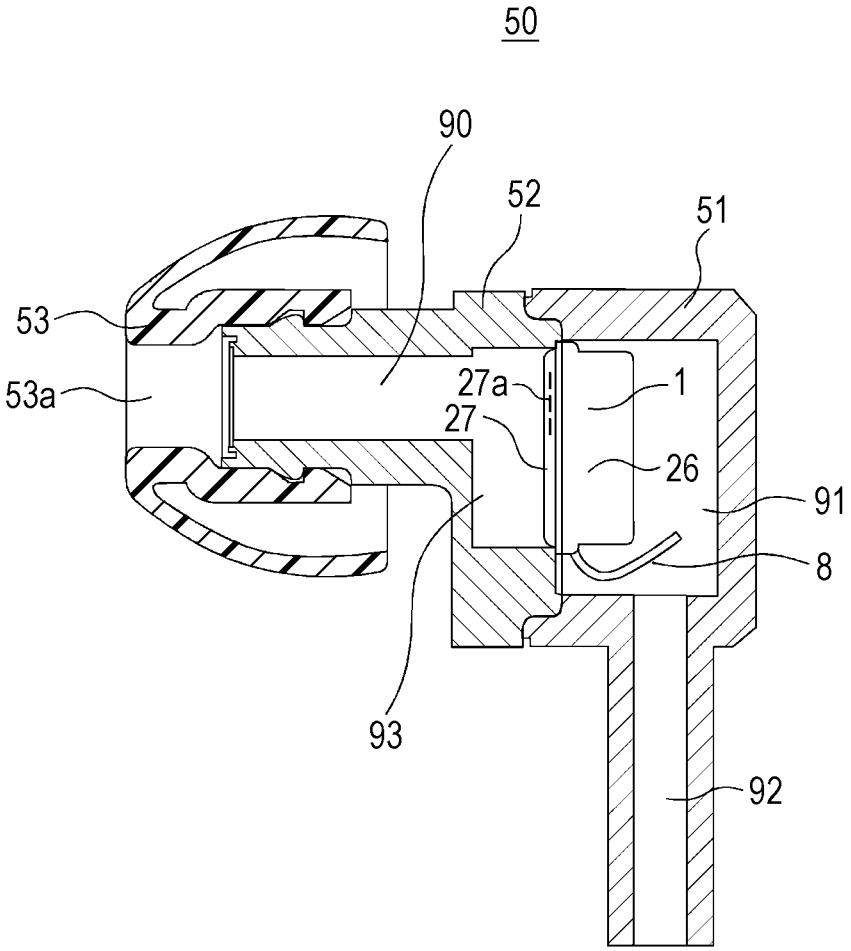
FIG. 7 illustrates a third example of structure of the earphone of the other embodiment.

A third example of structure is described with reference to FIG. 7.

In this example, the structure is such that an air chamber 93 communicating with the sound path tube 90 is formed in the earphone casing where the acoustic transducer 1 is disposed. As can be seen from FIG. 7, the inner structure of the front casing 52 and the acoustic transducer 1 (the upper surface side of the cover body 27) form the air chamber 93 with hermeticity.

The sound from the sound output hole 27*a* is outputted to the air chamber 93, and this sound reaches the sound discharging hole 53*a* of the earpiece 53 from the sound path tube 90.

Also in this structure, effects similar to those of the first example of structure can be obtained. Furthermore, depending on the design of the air chamber 93, acoustic characteristics can be adjusted.

5. Fourth Example of Structure of the Earphone

Figure 8A:
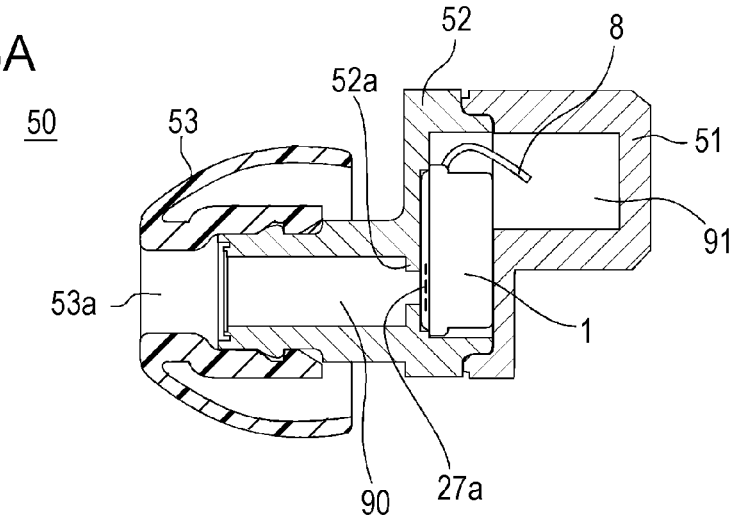
FIGS. 8A to 8C illustrate a fourth example of structure of the earphone of the other embodiment.
Figure 8B:
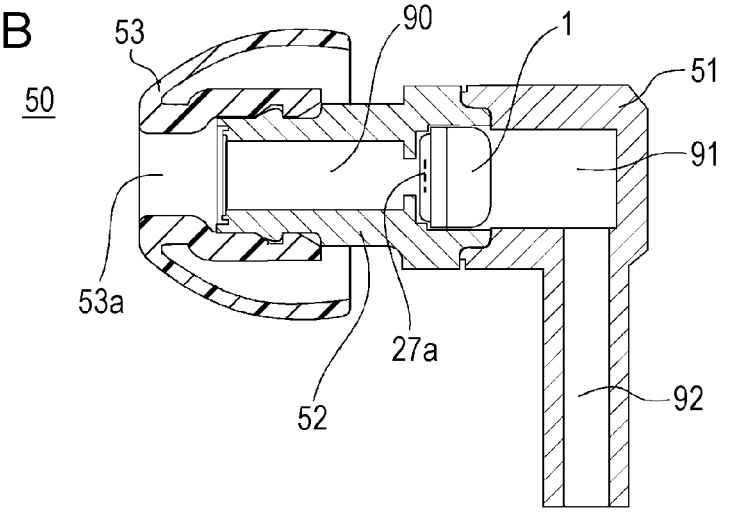
Figure 8C:
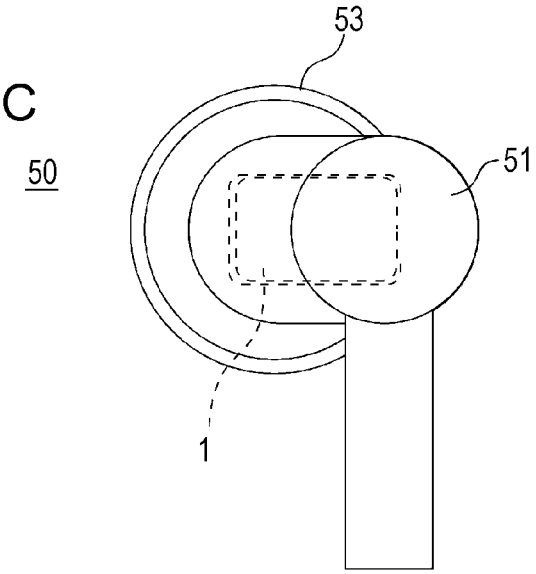

A fourth example of structure is described with reference to FIGS. 8A, 8B, and 8C. FIG. 8A depicts an inner structure when the earphone is viewed from above, FIG. 8B depicts the inner structure when the earphone is viewed from a side surface direction, and FIG. 8C depicts a rear view of the earphone.

Compared with the first to third examples of structure described above, the posture of the disposed acoustic transducer 1 is different by 90 degrees in this example.

The front casing 52 is configured to be a casing in an approximatelyeL shape when viewed from above as depicted in FIG. 8A. Inside the front casing 52, the acoustic transducer 1 is disposed so as to abut on the end 52*a* of the sound path tube 90. Accordingly, the sound output hole 27*a* faces the sound path tube 90.

Also in this structure, effects similar to those of the first example of structure can be obtained. That is, although the shape of the earphone casing is varied, the sound output hole 27*a* can be disposed so as to face the sound path tube 90, while the posture of the disposed inner acoustic transducer 1 is changed according to the shape of the earphone casing.

In view of this idea, other examples can be thought such that the acoustic transducer 1 is disposed as being tilted leftward or rightward or as being tilted forward or backward in the earphone casing.

Note that also in the example of structure in FIGS. 8A to 8C, as in the example of FIGS. 6A to 6C, the sound output hole 27*a* may face the sound path tube 90 via the shock absorbing member 80.

Also, the acoustic transducer 1 of the present example has the sound output hole 27*a* formed at the position eccentric from the center on the upper surface of the cover body 27. In the structure as depicted in FIGS. 8A to 8C, however, with the sound output hole 27*a* being at an eccentric position, the layout of the inner structure and the outer shape design of the earphone casing can be facilitated.

6. Fifth Example of Structure of the Earphone

A fifth example of structure is described with reference to FIGS. 9A to 9C.

Figure 9A:
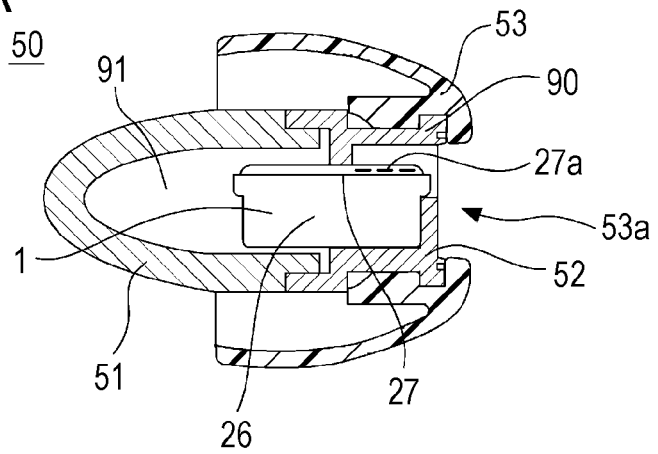
FIGS. 9A to 9C illustrate a fifth example of structure of the earphone of the other embodiment.
Figure 9B:
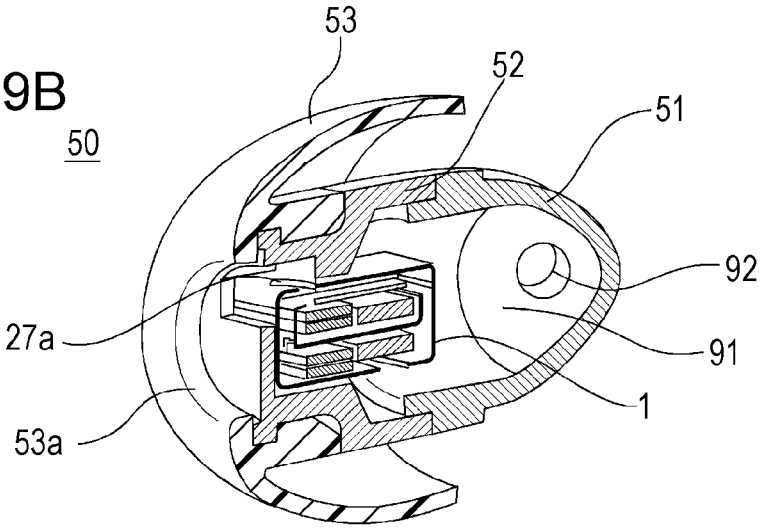

FIG. 9A is a sectional view of an earphone structure, and FIG. 9B is a perspective view of a section of an inner structure. FIG. 9C is a perspective view of an example of an outer view of the earphone.

Figure 9C:
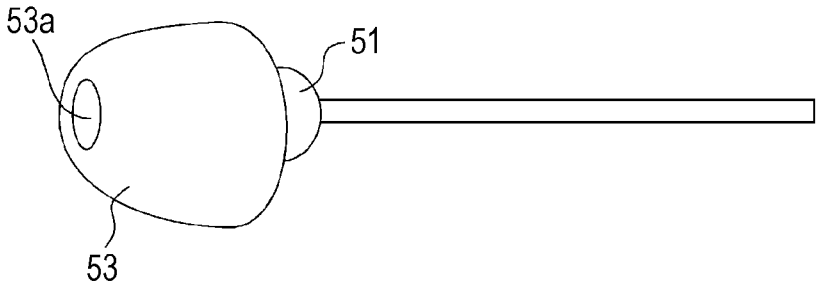

This fifth example of structure is advantageous for, by way of example, an extremely small earphone casing such that the front casing 52 and the rear casing 51 are almost entirely hidden from the earpiece 53 as depicted in FIG. 9C.

As depicted in FIGS. 9A and 9B, in the earphone casing, the acoustic transducer 1 is disposed so as to take a posture in which its front end (the portion depicted in FIG. 1D) is on an earpiece 53 side.

And, the cover body 27 having the sound output hole 27*a* is in a state of forming the side surface of the sound path tube 90, and the sound output hole 27*a* is positioned inside the sound path tube 90.

Also in this case, the sound outputted from the sound output hole 27*a* reaches the sound discharging hole 53*a* of the earpiece 53 from the sound path tube 90, and is guided to the ear hole of the user.

Also in this example of structure, effects similar to those of the first example of structure can be obtained. In particular, since the structure is such that part of the acoustic transducer 1 enters the inside the sound path tube 90, the structure is very advantageous for decreasing the size of the earphone casing.

7. Modification Example

While various examples of structure as embodiments have been described, the structure of the earphone of the embodiments of the present disclosure is not meant to be restricted to the examples described above. The outer and inner structures of the earpiece 53, the front casing 52, and the rear casing 51 can be variously assumed. In any event, these structures can be any as long as the sound output hole 27*a* of the acoustic transducer 1 can be disposed so as to be acoustically coupled directly to the sound path that guides sound to the user's ear hole without any coupling member such as a tube.

While the earpiece 53 is structured to be mounted on the front casing 52 separately from the earphone casing in the description above, the earpiece part may be integrally formed as part of the earphone casing. That is, a sound discharging hole for outputting sound to the user may be formed of the earpiece or the earphone casing.

Also, the structure of the acoustic transducer 1 is not meant to be restricted to the examples depicted in FIGS. 1A to 1E, FIG. 2, and FIG. 3. The acoustic transducer 1 of the embodiments of the present disclosure may be any as long as it has the sound output hole 27*a* formed on the surface that faces the vibration surface of the diaphragm 22 inside.

The shape of the sound output hole 27*a* can be variously assumed in addition to a circle, such as an oval, an ellipse, a polygon, and any other various figures.

Also, the hole size of the sound output hole 27*a* can be variously assumed. In particular, in consideration of a loss in high frequency, it is suitable to set a large hole area.

The present disclosure contains subject matter related to that disclosed in Japanese Priority Patent Application JP 2010-229527 filed in the Japan Patent Office on Oct. 12, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An earphone comprising:

an earphone casing inside which a sound path that guides sound to a sound discharging hole is formed; and an acoustic transducer disposed inside the earphone casing; wherein the acoustic transducer includes an accommodation casing having accommodated therein a yoke on which paired magnets disposed so as to face each other are mounted, a coil to which a driving current is supplied, an armature provided with a vibrating part vibrating when the driving current is supplied to the coil, the vibrating part being disposed between the paired magnets through the coil, and a diaphragm coupled to the vibrating part of the armature, a sound output hole is formed on a surface that faces a vibration surface of the diaphragm in the accommodation casing, and the acoustic transducer has the sound output hole disposed in the earphone casing so that the sound output hole is acoustically coupled to the sound path.

2. The earphone according to claim 1, wherein the acoustic transducer has the sound output hole disposed in the earphone casing so that the sound output hole faces the sound path.

3. The earphone according to claim 2, wherein the acoustic transducer has the sound output hole disposed in the earphone casing so that the sound output hole faces the sound path via a shock absorbing member.

4. The earphone according to claim 1, wherein an air chamber communicating with the sound path is formed in the earphone casing in which the acoustic transducer is disposed, and the acoustic transducer is disposed in the earphone casing so that an output sound from the sound output hole reaches the sound path via the air chamber.

5. The earphone according to claim 1, wherein the acoustic transducer is disposed in the earphone casing so that the sound output hole is positioned inside the sound path.

6. The earphone according to claim 1, wherein the sound output hole of the acoustic transducer is formed at a position eccentric from a center on the surface that faces the vibration surface of the diaphragm.

7. An acoustic transducer comprising an accommodation casing having accommodated therein:

a yoke on which paired magnets disposed so as to face each other are mounted;

a coil to which a driving current is supplied;

an armature provided with a vibrating part vibrating when the driving current is supplied to the coil, the vibrating part being disposed between the paired magnets through the coil; and a diaphragm coupled to the vibrating part of the armature; wherein a sound output hole is formed on a surface that faces a vibration surface of the diaphragm in the accommodation casing such that, when the diaphragm vibrates, the diaphragm vibrates in a direction toward and away from the sound output hole.

* * * * *